US006367140B2

(12) United States Patent
Gueydan

(10) Patent No.: US 6,367,140 B2
(45) **Date of Patent: *Apr. 9, 2002**

(54) DEVICE FOR HOLDING CAMS DURING THEIR BINDING ON A TUBE BY EXPANSION OF THE TUBE

(75) Inventor: Henri Gueydan, Moirans (FR)

(73) Assignee: Federal-Mogul Sintered Products, Veurey-Voroize (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/425,984

(22) Filed: Oct. 25, 1999

(30) Foreign Application Priority Data

Oct. 26, 1998 (FR) ..... 98 13543

(51) Int. Cl.[7] ..... B25B 27/14; B21D 53/84

(52) U.S. Cl. ..... 29/281.1; 29/283.5; 29/523; 29/888.1

(58) Field of Search ..... 29/281.1, 283.5, 29/888.1, 421.1, 523

(56) References Cited

U.S. PATENT DOCUMENTS

| | | | | | |
|---|---|---|---|---|---|
| 4,597,365 | A | * | 7/1986 | Madaffer | 29/283.5 |
| 4,738,012 | A | * | 4/1988 | Hughes et al. | 29/888.1 |
| 4,761,870 | A | * | 8/1988 | Urano | 29/421.1 |
| 4,763,614 | A | * | 8/1988 | Burgio Di Aragona | |
| 4,875,270 | A | * | 10/1989 | Krips et al. | 29/888.1 |
| 4,882,825 | A | | 11/1989 | Nakamura | |
| 5,157,832 | A | * | 10/1992 | Hughes | 29/888.01 |
| 5,280,672 | A | * | 1/1994 | Hochstein | 29/888.1 |
| 5,437,097 | A | * | 8/1995 | Yanagawa | 29/523 |
| 5,570,507 | A | * | 11/1996 | Hochstein | 29/888.1 |

FOREIGN PATENT DOCUMENTS

| | | | | |
|---|---|---|---|---|
| EP | 599751 | * | 6/1994 | 29/283.5 |
| JP | 62-097721 | * | 5/1987 | 29/888.1 |
| JP | 04-022521 | * | 1/1992 | |

* cited by examiner

*Primary Examiner*—S. Thomas Hughes
*Assistant Examiner*—Eric Compton
(74) *Attorney, Agent, or Firm*—McDermott, Will & Emery

(57) ABSTRACT

A device for holding sintered cams during their binding on a tube by expansion of the tube, including, for each cam, two blocks intended for enclosing the cam in housings complementary to the cam contour. The dimensions of the housings are chosen so that the play between the housings and the largest cam within a predetermined tolerance range is as close to zero as possible by excess, the two blocks being provided to bear against each other whatever the dimensions of the cam within the tolerance range.

3 Claims, 2 Drawing Sheets

DEVICE FOR HOLDING CAMS DURING THEIR BINDING ON A TUBE BY EXPANSION OF THE TUBE

BACKGROUND OF THE INVENTION

1. Field of the Invention

The present invention relates to the forming of a camshaft by binding the cams on a tube by expanding the tube. It more specifically relates to a device for holding the cams during the binding.

2. Discussion of the Related Art

FIG. 1 schematically illustrates cam being secured on a tube such as described, for example, in U.S. Pat. No. 4,597,365. Several cam 10 are arranged around a tube 12 that initially engages with a slight play in bores of cam 10. Cams 10 are held at desired axial and angular positions by a holding device not shown in FIG. 1.

A tube expander 14 is engaged in tube 12, and its diameter is such that the external diameter of tube 12 is enlarged to become slightly greater than the internal diameter of cams 10. This results, as shown in the left-hand portion of FIG. 1, in a permanent deformation of the tube and a binding thereof in the bores of cams 10.

In the above-mentioned U.S. patent, cams 10 are forged steel cams, the angular position of which is ensured by V shaped holders. The cam manufacturing precision being insufficient, it is necessary to rectify the cams after their binding on the tube, to restore the required dimensions.

The applicant has used this assembly technique for sintered cams. Sintered cams are generally made with a precision such that a rectification could be omitted if they were properly positioned during the binding.

FIG. 2 illustrates a front view of a sintered cam arranged in a holding device such as used by the applicant. For each cam 10, an upper block 16 and a lower block 17 intended for accomodating cam 10 and holding its angular position during the binding are provided. They are further used to avoid the breaking of the cam during the binding.

In blocks 16 and 17, housings corresponding to the contour of cam 10 have been precisely worked, by choosing for these housings the maximum dimensions of the cam manufacturing tolerance range. As shown, a play is provided between blocks 16 and 17, on either side of the cam, so that the housings of these cams always bear with no play on the circumference of cam 10.

With this configuration, it has been expected to ensure a faultless positioning of cam 10 while preventing the cam from breaking during the binding. Indeed, sintered cams are less resistant than cams obtained by other methods and risk cracking during the binding if they are not held along their entire circumference.

Upper blocks 16 and lower blocks 17 are attached side by side along the tube, for example by bolts that run through holes 19 of the cams. Two half-cases that are firmly held against each other, for example, by means of a press, during the binding are thus formed.

Despite these precautions, some cams still appear to have a bad angular position and must be rectified.

SUMMARY OF THE INVENTION

An object of the present invention is to provide a device for holding the cams during their binding on a tube, which enables obtaining a camshaft that requires no rectification.

To achieve this object, the present invention provides a device for holding sintered cams during their binding on a tube by expansion of the tube, including, for each cam, two blocks intended for enclosing the cam in housings complementary to the cam contour. The dimensions of the housings are chosen so that the play between the housings and the largest cam in a predetermined tolerance range is as close to zero as possible by excess, the two blocks being provided to bear against each other whatever the dimensions of the cam within the tolerance range.

According to an embodiment of the present invention, the device includes means for preventing a play from appearing between the two blocks associated with a cam during the tube expansion.

According to an embodiment of the present invention, several blocks are assembled side by side along the tube, forming two half-cases, the two half-cases being held against each other during the tube expansion by several independent jacks, distributed on a surface of one of the half-cases.

The foregoing objects, features and advantages of the present invention, will be discussed in detail in the following non-limiting description of specific embodiments in connection with the accompanying drawings.

DETAILED DESCRIPTION

Figure 1:
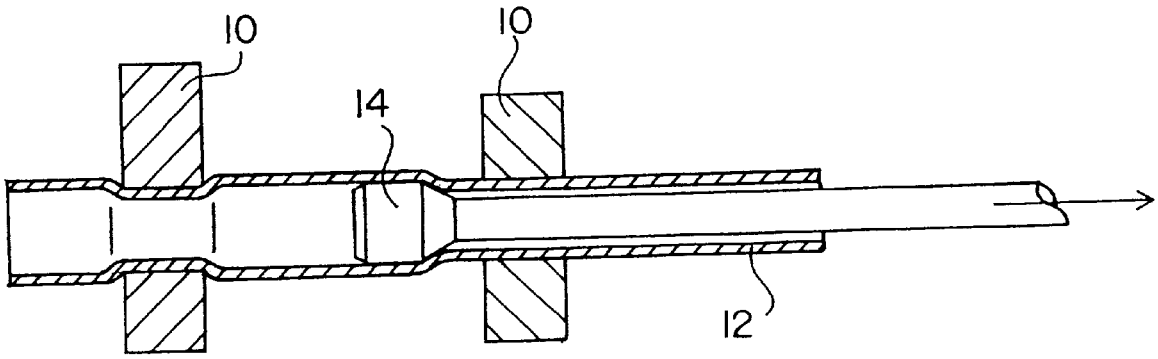
Fig 1 PRIOR ART
FIG. 1, previously described, illustrates a conventional method of binding cams on a tube.
Figure 2:
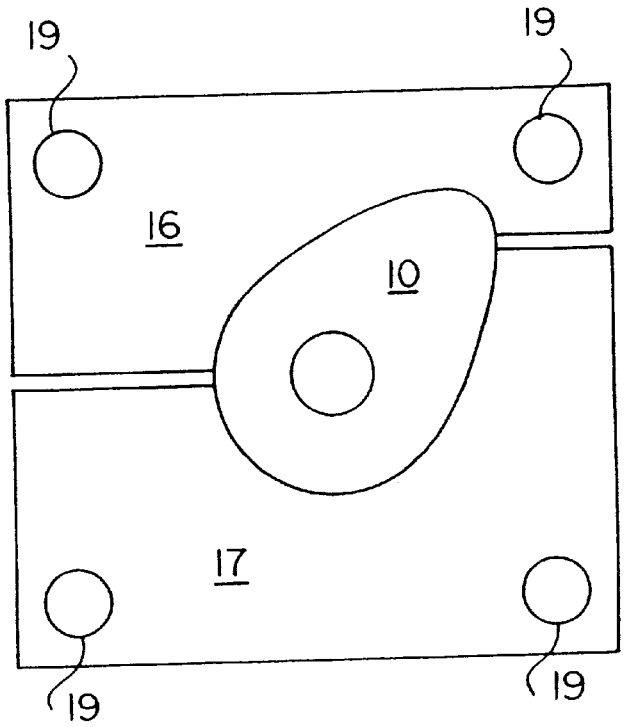
Fig 2 PRIOR ART
FIG. 2 shows a device for holding a sintered cam during the operation illustrated in FIG. 1.

The present invention is based on an analysis of the phenomena occurring during the binding when using a cam holding device of the type in FIG. 2.

When several juxtaposed blocks of the type in FIG. 2 are used to hold several cams along a tube, the cams having the smallest dimensions in the admitted tolerance range appear to be arranged with a play between their blocks. Indeed, when the two half-cases formed by the juxtaposition of the blocks bear against each other, only two cams are held with no play between their two blocks. However, the other cams, held with a play, do not crack. This shows that a certain peripheral play can be left between the cam and the two blocks without risking breakage during the binding.

The present invention provides suppressing the play at the level of the parting line and holding all cams with a peripheral play. Conversely to what could be expected, the accuracy of the angular positioning is thus improved.

Figure 3:
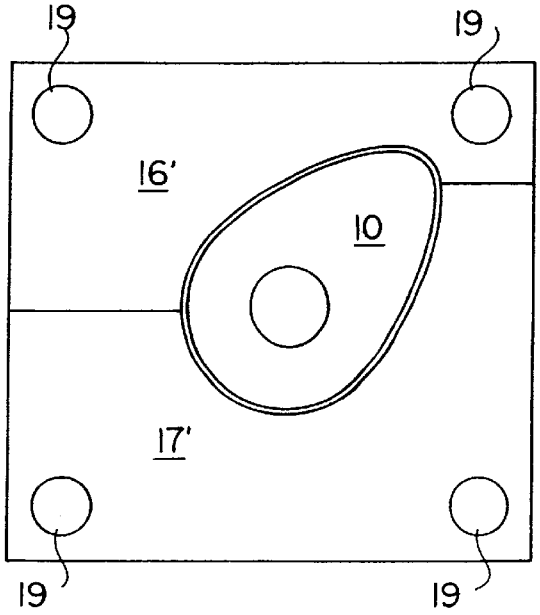
FIG. 3 shows an embodiment of a cam holding device according to the present invention.

FIG. 3 shows an example of a cam holding device according to the present invention, making use of the above-mentioned teachings. This drawing shows the same elements as FIG. 2, designated by same references. The upper and lower blocks, here designated as 16', and 17', include according to the present invention housings that are worked to the dimensions of the largest cam in the admitted tolerance range (generally, approximately 30 $\mu$m). More specifically, the housings are worked so that the play between the largest cam and the blocks is strictly greater than zero, taking into account the working precision (generally approximately 5 $\mu$m).

Thus, as shown, all cams 10 are held between blocks 16' and 17' with a play, this play being further ensured by the fact that the two blocks bear against each other on either side of the cams. It should be noted that this play enables an angular clearance of the cams. This angular clearance is however smaller than the angular position tolerance of the cams. Further, the play is reduced with the cam thermal expansion during the binding operation, whereby the obtained angular precision is practically that of the block housing working.

It is essential, to obtain this precision, that the blocks always bear against each other during the binding operation. The largest cams tend to separate blocks 16' and 17' during this operation, and thus to create a play between said blocks. This is of course not desirable for the above mentioned reasons.

As previously indicated, a case formed of the block juxtaposition used to be kept closed by a press. More specifically, the lower case surface would bear against the press plate, and the press piston would bear at the center of the upper case surface. In this case, a play could appear at the level of the end blocks of the case due to the case resilience, and this even if measures were taken to rigidify the case.

Figure 4:
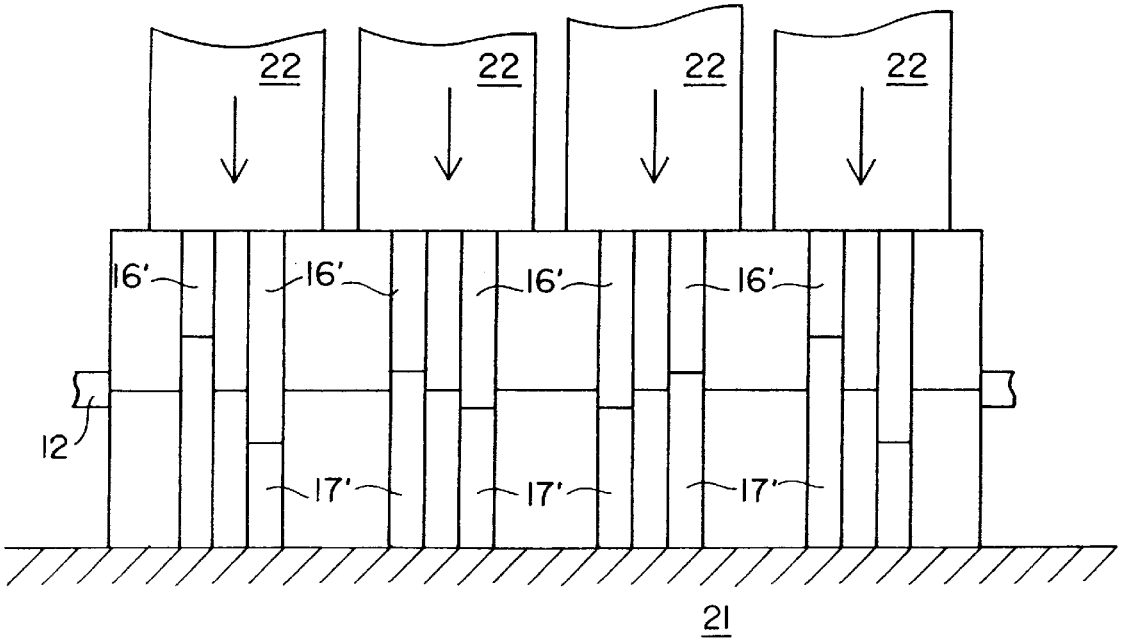
FIG. 4 shows two half-cases formed of a juxtaposition of holding blocks of the type in FIG. 3 and a mode of holding the two half-cases against each other.

FIG. 4 shows a case closing mode avoiding this disadvantage. FIG. 4 shows, in side view, several blocks used to form a camshaft. The blocks have the thickness of the cams and they are axially positioned by spacers of adapted thickness, the blocks and spacers being assembled, for example, by means of bolts running therethrough. Of course, the spacers are in two halves, the ones forming with the upper half-case the upper blocks, and the others forming the lower half-case with the lower blocks.

The lower half-case is laid on plate 21 of a hydraulic press. The upper half-case is held against the lower half-case by several cylinders 22 distributed on the upper case surface along the axis of tube 12. These cylinders move independently, and can be pressurized independently. With this configuration, by applying a sufficient pressure, the separating of the blocks during the binding operation is avoided, even for the largest cams.

Camshafts obtained by means of the holding device according to the present-invention require no rectification.

Of course, the present invention is likely to have various alterations, modifications, and improvements which will readily occur to those skilled in the art. Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. In combination, a device for holding sintered cams during their binding on a tube by expansion of the tube and the cams, including, for each cam, two blocks intended for enclosing the cam in housings complementary to the cam contour, wherein the dimensions of the housings are chosen so that the play between the housings and a largest one of said cams is greater than 0 and less than 5 $\mu$m, the two blocks bearing against each other.

2. The holding device of claim 1, including means for preventing a play from appearing between the two blocks associated with said largest cam during the tube expansion.

3. The holding device of claim 2, wherein several blocks are assembled side by side along the tube, forming two half-cases, the two half-cases being pressed against each other during the tube expansion by several independent cylinders, distributed on a surface of one of the half-cases.

* * * * *